United States Patent [19]

Itahana et al.

[11] Patent Number: 4,928,723

[45] Date of Patent: May 29, 1990

[54] CAPACITY CONTROL VALVE FOR A COMPRESSOR

[75] Inventors: Tsutomu Itahana; Hideo Kanno; Tetsuo Ono; Futoru Furuta; Susumu Kobayashi; Ryosaku Akimoto; Ryuhei Tanigaki, all of Nagoya, Japan

[73] Assignee: Mitsubishi Jukogyo Kabushiki Kaisha, Tokyo, Japan

[21] Appl. No.: 362,478

[22] Filed: Jun. 7, 1989

[30] Foreign Application Priority Data

Jun. 10, 1988 [JP] Japan ..... 63-76433

[51] Int. Cl.[5] ..... G05D 16/10

[52] U.S. Cl. ..... 137/116.3; 417/309

[58] Field of Search ..... 137/116.3; 417/309; 62/196.3, 228.3

[56] References Cited

U.S. PATENT DOCUMENTS

| | | | |
|---|---|---|---|
| 2,715,992 | 8/1955 | Wilson | 417/309 |
| 3,041,847 | 7/1962 | Harter | 417/309 X |
| 3,224,662 | 12/1965 | Oldberg | 417/309 X |
| 3,261,541 | 7/1966 | Kocher | 417/309 |

*Primary Examiner*—Robert G. Nilson

*Attorney, Agent, or Firm*—Fleit, Jacobson, Cohn, Price, Holman & Stern

[57] ABSTRACT

An improvement in a capacity control valve for use in a fluid compressor with a relatively high pressure HP and a relatively low pressure LP for changing the operational characteristics thereof by using the relatively high pressure HP taking into consideration that an increased pressure loss of the refrigerant as generated from an increased flow rate thereof and the thermal load on the car cooler would occasionally occur on the part of the relatively high pressure HP during the operation. Wherein a capacity control valve, of the type operative to take the intermediate pressure AP, for the control of a specific amount of compressed gas to be bypassed to the suction side of the fluid compressor, as a linear function of the relatively low pressure LP using a differential pressure between the relatively high pressure HP and the relatively low pressure LP of the fluid compressor, comprises an adjusting device adapted to adjust the intermediate pressure AP in such a manner that the relative low pressure LP is made lower as the relatively high pressure HP becomes higher, and the relatively low pressure LP is made higher as the relatively high pressure HP becomes lower.

1 Claim, 4 Drawing Sheets

CAPACITY CONTROL VALVE FOR A COMPRESSOR

FIELD OF THE INVENTION AND RELATED ART STATEMENT

The present invention relates generally to a compressor, or more particularly to a capacity control valve adaptable to a refrigerant compressor which is incorporated in a car cooler, or the like.

For reference, the Applicant has already proposed an improvement in or relating to a capacity control valve for such an application by way of Japanese Utility Model Registration Application No. 128,861/1987, which is incorporated herein for the reference, as shown typically in FIGS. 3 and 4 accompanying therewith.

This particular capacity control valve 1 is, as shown in FIG. 4 by way of its preferred embodiment, mounted upon a casing 3 of a compressor, which incorporates an unloading valve 2 therein, through a flange 4 by using bolts 5.

There is seen mounted a bellows 34 in a space defined in the upper portion of a cylindrical body 10, with the upper end of the bellows 34 being fixedly connected to a holder 35 and with the lower end or the inner diameter thereof mounted on the outer circumference of the lower end of a shaft guide 36 by way of, for instance, soldering or in the like manner, thereby defining a space or chamber 38 between the outer circumference of the bellows 34 and the inner circumference of the cylindrical body 10.

The holder 35 may be fixedly mounted in position at the upper end of the cylindrical body 10 by way of calking or the like manner, and in the center thereof there is seen installed threadedly an adjuster element 13 which is manually adjustable for the purpose of adjusting the urging force of a coil spring from one end thereof.

There is provided a coil spring 14 resting in the space defined between the bellows 34 and the shaft guide 36 in such a manner that the upper end of this coil spring 14 may abut upon the lower end surface of the adjuster 13 and the lower end thereof is set against the annular shouldered surface of a spacer sleeve 15 mounted slidably on the outer circumference of the shaft guide 36.

On the other hand, there is seen disposed slidably a longitudinal shaft 16 in the interior of a sliding opening 39 defined in the cylindrical body 10 in such a manner that the shaft 16 may be shifted in sliding upward and downward motions, and that the gaps between the outer circumference of the longitudinal shaft 16 and the sliding opening 39 is sealed fluid-tight by way of an O-ring seal 40. It is also seen that the reduced-diametered portion of this shaft 16 extends slidably in sealed fashion upwardly through an O-ring seal 42 mounted in the annular groove of a holder 41 which is held in position of the cylindrical body 10, with the upper end of the longitudinal shaft 16 being inserted into the central bore hole of the shaft guide 36 and connected securely thereto by way of soldering or the like manner.

With this arrangement, an annular gap defined in the sliding hole 39 with the longitudinal shaft 16 may be partitioned sealedly by the two O-ring seals 40 and 42 disposed opposedly with an interval, whereby there is defined an annular space or chamber 43 between these O-ring seals, and also a like space or chamber 44 defined below the O-ring 40 and at the lower end of the shaft 16.

In the central hole defined in the central lower end of the longitudinal shaft 16, there is seen inserted the leading end of a longitudinal pin 19, with its lower end extending downwardly through a through hole 33 defined in the cylindrical body 10 in slidable and sealing fashion, abutting operatively upon a ball valve element 18.

In a central recess 37 defined extending along the central axis of the cylindrical body 10 in the lower portion thereof or downwardly of the central through hole 33 thereof, there are operatively disposed an upper valve seat block 49 and a lower valve seat block 52, which rest fixedly in the central recess 37 by a closing plug 56 for the hermitical enclosure of the lower end opening of the recess, which closing plug may be fixed securely in position by way of, for example, calking or in any other manners.

The upper valve seat block 49 comprises a ball valve guide chamber 45 allowing the ball valve element 18 held operatively therein to play longitudinally along the central axis thereof, a valve port or opening 46 opened upwardly in the upper end surface of the valve guide chamber 45 allowing to be closed by the ball valve element 18, and a lateral opening 48 extending transversally and opening in one lateral side or the left side of the valve guide chamber 45 as viewed in FIG. 4. The longitudinal pin 19 extends through this valve port 46, and the lateral opening 48 extends through a transversal opening 47 provided in the lateral side of the cylindrical body 10 extends in communication with an intermediate pressure AP in a chamber 66 through the transversal opening 47 defined in the cylindrical body 10.

The lower valve seat block 52 is designed comprising a valve port 51 to be opened and closed operatively by the ball valve element 18, a filter chamber 61 in which a fluid filter 55 is contained, and a central passage 68 which is adapted to intercommunicate between the valve port 51 and the filter chamber 61, and in the central passage 68 there is seen defined an orifice 50 at the entrance to the filter chamber 61.

In the center of the closing plug 56, there is defined a pressure transmitting passage 54 which serves to transmit a higher pressure HP to the filter chamber 61.

In a conic space or gap delimited between the upper valve block 49 and the lower valve block 52, there is disposed operatively a coil spring of conic shape 22, by which the ball valve element 18 is urged upwardly in resiliency so that it may come to contact resiliently with the lower end of the longitudinal pin 19.

Between the central through hole 33 of the cylindrical body 10 and the valve port 46, there is seen defined a central space or chamber 53 in the center of the cylindrical body 10 by the upper valve block 49, this central chamber 53 being adapted to communicate by way of an outlet hole 60 with a pressure chamber 65 under a lower pressure LP.

Also, anther chamber 38 is seen provided in the inside of the upper portion of the cylindrical body 10 adapted to communicate with the pressure chamber 65 with the relatively low pressure LP by way of a pressure transmitting passage 57, and a further central chamber 43 is provided communicating with the lateral opening 48 under the intermediate pressure AP by way of a pressure transmitting passage 58, and still another central chamber 44 is seen in communication with the pressure chamber 65 under the relatively low pressure LP by way of a transversal opening 59, respectively.

Also seen provided is a recess 69 defined in the compressor casing 3 and around the outer circumference of the cylidrical body 10, and in the annular spacing or gap defined between the inner circumference of the recess 69 and the operatively disposed O-ring seals 62, 63 and 64. There is delimited the pressure chamber 65 under the relatively low pressure LP between the O-rings 62 and 63, and in the like manner there is also delimited a pressure chamber 66 under the intermediate pressure AP between the O-rings 63 and 64, and there is further delimited a pressure chamber 67 under the relatively high pressure HP, respectively.

Now, this is to explain the operation of the conventional control valve 1 with the general construction stated above, as follows.

The relatively low pressure LP is firstly transmitted to the chamber 38 in the upper portion of the cylindrical body 10 from the pressure chamber 65 through the pressure transmitting passage 57, working upon the bellows 34 to be deformed in the direction of its axis. This deformation of the bellows 34 may be transmitted to the ball valve element 18 through the shaft guide 36, the longitudinal shaft 16 and the longitudinal pin 19, thus generating the shifting motions of the ball valve element 18 in the longitudinal directions, thereby to change the degrees of opening at the valve ports 46 and 51 so as to attain the control of the intermediate pressure AP, accordingly.

Main forces working to urge upon the longitudinal shaft 16 are as follows.

Upward force $F_1$: a force working under the relatively low pressure LP introduced into the chamber 38 upon the bellows 34

$F_2$: a force working under the relatively low pressure LP introduced into the chamber 44 upon the longitudinal shaft 16 and the lower surface of the O-ring seal 40

Downward force $F_3$: a rebound force of the bellows 34

$F_4$: a force fedback under the intermediate pressure AP introduced into the chamber 43 upon the upper surface of the O-ring seal 40

$F_5$: a rebound force of the coil spring 14

These working forces may be expressed in the following equations; that is, $$F_1=K_1\times LP;\ F_2=K_2\times LP;\ F_4=K_3\times AP \quad (1)$$

where, $K_1$ to $K_3$ are constants which may be determined from the dimensions of the relevant parts.

Incidentally, the equation to attain the current balancing of such forces working upon the longitudinal shaft 16 may be expressed as follows;

$$F_1+F_2=F_3+F_4+F_5 \quad (2)$$

The following equation concerning AP may be obtained from the equations (1) and (2) above;

$$AP=a\times LP+b \quad (3)$$

where, a and b are constants.

This equation (3) represents a straight line segment b - e as viewed in FIG. 3, which is a grajphic representation showing the specific relationship of pressures LP and AP. Now, in this graphic representation, the line segment a - b shows the characteristic relationship of these pressures when the valve port 51 is closed generally completely, and the line segment e - f, namely, wherein the intermediate pressure AP is constant, shows the specific condition that the valve port 46 is generally closed, respectively.

In this respect, it is notable that the gradient in the characteristic relationship of pressures AP to LP as required from the part of the fluid compressor may be altered optionally by predetermining the current value of the constant a in the equation (3). Also, it is notable that the point b where the line segment a - b turns to be the segment b - e may be set optionally by changing the resilient effort or rebound force of the coil spring 14, accordingly.

Next, the reference is made to the capacity control operations of the fluid compressor for a car cooler, which is equipped with the present capacity control valve 1, as follows.

Firstly, suppose that the capacity control valve 1 is, as shown in FIG. 3, operative to control the current amount of compressed gas wherein the pressure LP is to be bypassed to the suction side through the unload valve 2 within a range of ($LP_1$–$LP_2$).

Now, when the compressor is started-up in operation, and when the current thermal load on the part of the car cooler is substantially great, LP will turn to be higher in magnitude than $LP_2$, and the current LP is then introduced into the chamber 38 by way of the pressure transmitting passage 57, thereby generating a substantial upward force working upon the bellows 34. At this moment, the longitudinal shaft 16 is caused to be shifted upwardly overcoming the resilient urging force from the coil spring 14, thus causing the ball valve element 18 to be moved away from the valve port 51. Then, gas under the relatively high pressure HP may be directed from the pressure chamber 67 through the pressure transmitting passage 54, the filter 55, the orifice 50, the central passage 68, the valve port 51, the valve guide chamber 45, the valve port 46, the central chamber 53 and the outlet hole 60, into the pressure chamber 65 under the relatively low pressue LP.

In this condition, the current intermediate pressure AP is in the range represented by (b - e) as shown in FIG. 3. Consequently, in the condition $LP \geqq LP_2$, this intermediate pressure AP works upon the upper surface of the spool element 6 in the unload valve 2, causing the spool element 6 to be forced downwardly against the resilient force from the coil spring 7 so as to close the passage 9. With this operation, the refrigerant being bypassed from the delivery side to the suction side of the fluid compressor is then blocked from flowing.

When the thermal load on the part of the car cooler is thus relieved, the current pressure LP is caused to be decreased to the level of $LP_2$, the intermediate pressure AP is also caused to be lowered accordingly, and then the spool element 6 in the unload valve 2 is urged upwardly by the coil spring 7 to a higher position, where the through hole 8 in the spool element 6 comes to meet exactly the passage 9, whereby the refrigerant is now allowed to be bypassed from the delivery side to the suction side of the fluid compressor. In this position, there is attained a condition such that the current pressure LP is put in the range ($LP_2$–$LP_1$) wherein the current amount to be bypassed from the unload valve 2 is proportional to the relatively low pressure LP, accordingly.

However, since the capacity control valve 1 of a typical conventional construction as noted above is mounted immediately upon the compressor's casing 3, between the relatively low pressure LP and the current pressure in the evaporator of the car cooler, there would be a differential pressure, which corresponds to a current pressure loss as produced while the refrigerant is flowing through a fluid hose which is used to communicate the evaporator to the fluid compressor.

For this reason, in such an application that a flow rate of the refrigerant (a pressure loss) may change substantially accordingly to the current thermal load of the car cooler, there remains an inevitable problem such that the capacity control valve 1 of the conventional construction cannot control properly the current pressure in the evaporator of the car cooler.

On the other hand, as it is essential for the car cooler wherein there may exist a substantial thermal load particularly as in the hot summer season to serve as much cooling capability as practicably possible to an extent such that it does not get frozen up, it would then be required to set the working pressure of the evaporator to a lower limit where it is not put to be frozen up in the operation. In contrast, during such a mild season as the spring or the autumn, it is not necessary that the pressure of the evaporator is to be set to that lower limit as is required in the summer, and consequently, it is preferred to set it at a higher point than that for the summer season from the viewpoint of energy saving.

However, according to the conventional capacity control valve 1, it is typically constructed such that the intermediate pressure AP would be determined unconditionally and exclusively by the relatively low pressure LP, and consequently, it is not practicable to comply with such a requirement, accordingly.

OBJECT AND SUMMARY OF THE INVENTION

In an attempt to cope with such an undesired problem inherent to the conventional construction of the capacity control valve for a fluid compressor, the present invention is essentially directed to the provision of an efficient solution to such a problem. Therefore, this is directed to a useful improvement in this capacity control valve to advantageously change the operational characteristics thereof by using the relatively high pressure HP taking into consideration such an observation that an increased pressure loss of the refrigerant as generated from an increased flow rate thereof and the thermal load on the car cooler would occasionally occur on the part of the relatively high pressure HP during the operation. This improvement is, as summarized in brief, concerned with a capacity control valve for use in a fluid compressor with a relatively high pressure HP and a relatively low pressure LP thereacross, the capacity control valve being of the type operative to take the intermediate pressure AP, for the control of a specific amount of compressed gas to be bypassed to the suction side of the fluid compressor, as a linear function of said relatively low pressure LP using a differential pressure between the relatively high pressure HP and the relatively low pressure LP of the fluid compressor; which comprises an adjusting means adapted to adjust the intermediate pressure AP in such a manner that the relative low pressure LP is made lower as the relatively high pressure HP becomes higher, and that said relatively low pressure LP is made higher as said relatively high pressure HP becomes lower.

According to the improvement relating to a capacity control valve of the present invention, it is possible in practice to efficiently change the intermediate pressure AP in the control valve system in such a manner that the relatively low pressure LP may be made lower accordingly as the relatively high pressure HP grows higher, and that the relatively low pressure LP may be made higher as the relatively high pressure HP grows lower, respectively.

As a consequence, when a fluid compressor is installed into a car cooler system, it is now possible to control properly the current evaporating pressure in an evaporator incorporated in the car cooler according to the current thermal load on the part of the car cooler, thereby to make compatible the energy saving a reduced fuel consumption as well as an increased cooling capability of the system.

BRIEF DESCRIPTION OF THE DRAWINGS

The invention will now be described in detail with reference to the accompanying drawings, like parts being designated by like reference numerals wherein.

DETAILED DESCRIPTION OF A PREFERRED EMBODIMENT

There is shown generally in longitudinal cross-section a capacity control valve by way of a preferred embodiment of the invention.

Figure 1:
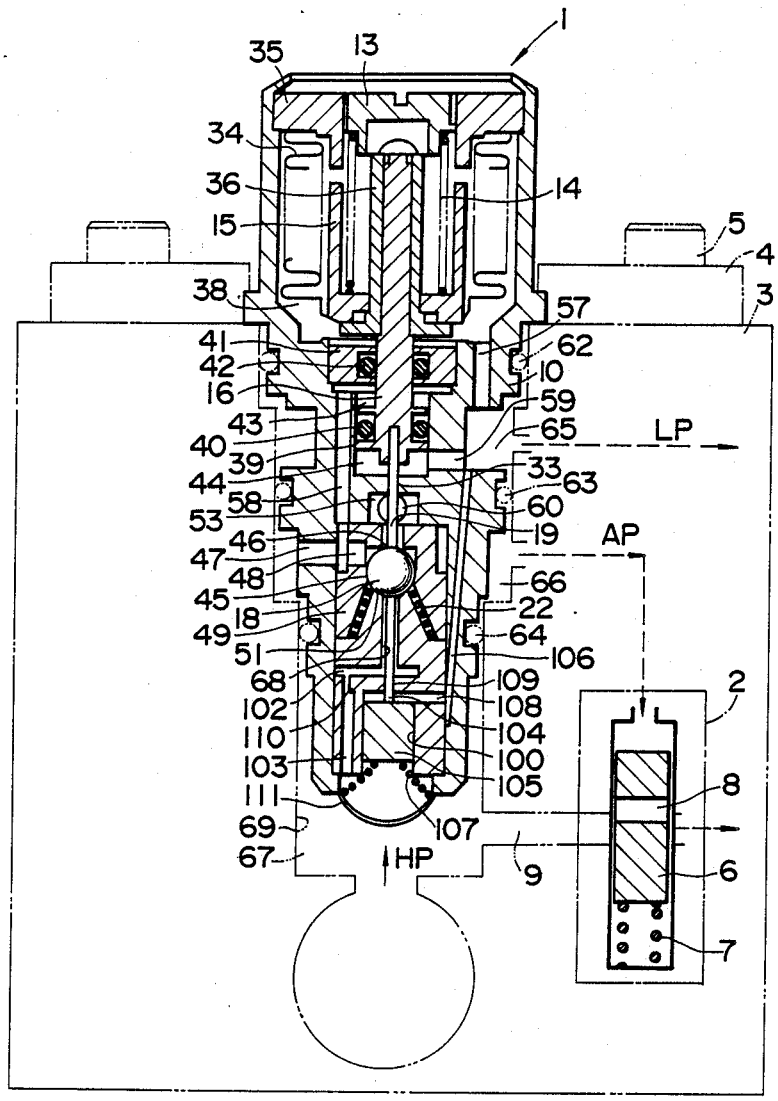
FIG. 1 is a longitudinal cross-sectional and partly schematic view of a preferred embodiment of the capacity control valve of the invention.

As generally shown in FIG. 1, there is seen provided a cylinder 100 in the lower surface of the lower valve seat block 52, into the inner opening of which cylinder a piston 105 is inserted sealingly and slidable longitudinally along the axis of the cylinder. Upon the upper end surface of this piston 105, the lower end of a longitudinal pin 104 extends abutting, which longitudinal pin extends longitudinally through an opening 109 provided in a lower valve seat block 52 in such a manner that it may move in sliding motion and sealingly through the opening 109, with its upper end extending upwardly through a chamber 102, a central passage 68 and a valve port 51 and abutting upon the lower surface of a ball valve element 18.

Also, this piston 105 biased resiliently upwardly by a cone-shaped coil spring 107 disposed below.

The lower end of the central passage 68 extends longitudinally in communication with the chamber 102, which chamber extends radially communicating with a pressure chamber 67 under the relatively high pressure HP by way of an orifice 110 and a pressure transmitting passage 103.

It is also seen that a cylinder chamber 108 as delimited upwardly of the piston 105 is placed in communication with a pressure chamber 65 under the relatively low pressure LP by way of a pressure balancing passage 106. Also in the lower end of the cylindrical body 10, there are seen the lower end surface of the piston 105 and a filter 111 mounted covering the entrance to the pressure transmitting passage 103.

Figure 4:
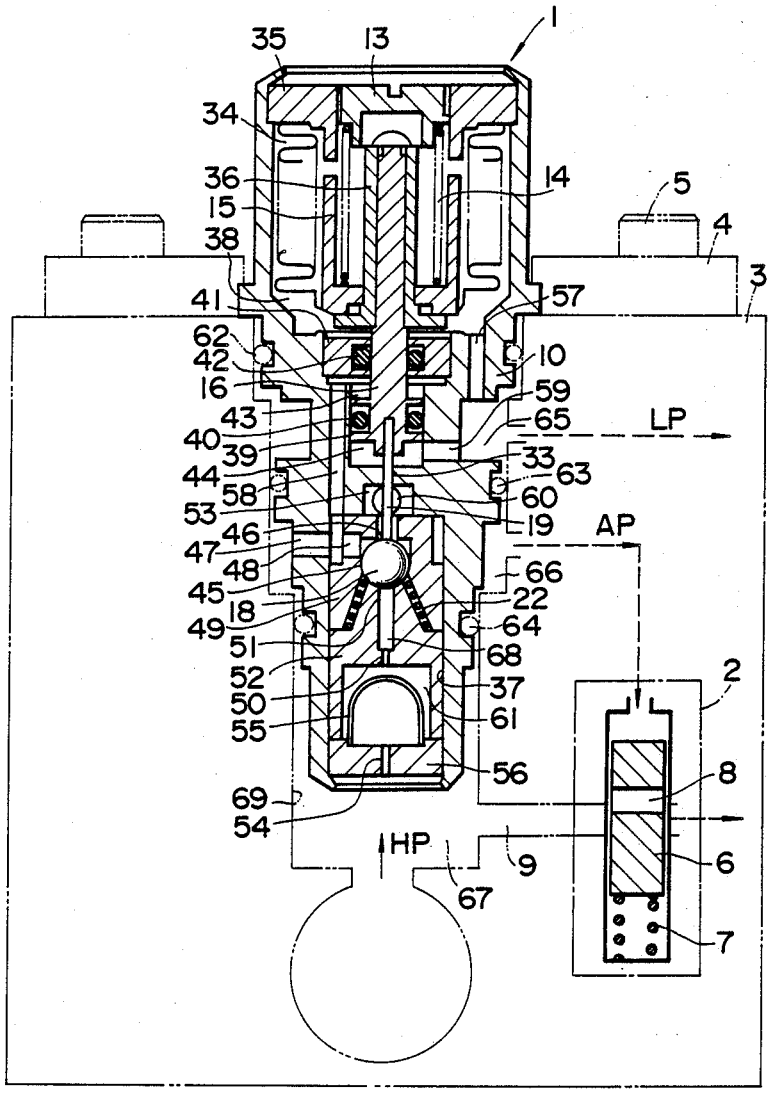
FIG. 4 (PRIOR ART)
FIG. 4 is a similar longitudinal cross-sectional view to FIG. 1 showing the general construction of a typical conventional capacity control valve.

It is to be noted that all other parts of the capacity control valve assembly are similar to those in the conventional construction shown in FIG. 4, which are designated by like reference numerals.

Incidentally, gas existing on the part of the relatively high pressure HP is directed from the pressure chamber 67 to the pressure transmitting passage 103 by way of the filter 111, and from there to a valve port 51 by way of the orifice 110, the chamber 102 and a central passage 68.

There is the relatively low pressure LP in the pressure chamber 65 is introduced into the cylinder chamber 108 by way of the pressure balancing passage 106, and then there is the relatively low pressure LP conveyed onto the upper end surface of the piston 105. On the other hand, as there is the relatively high pressure HP working upon the lower end surface of the piston 105, there occurs an upward thrust force from a differential pressure between the relatively high pressure HP and the relatively low pressure LP, which thrust force is relayed to the longitudinal shaft 16 through the longitudinal pin 104, the ball valve element 18 and the longitudinal pin 19.

The effect of main forces working upon the longitudinal shaft 16 are as follows;

Upward force $F_1$: a force working under the relatively low pressure LP introduced into the chamber 38 upon the bellows 34

$F_2$: a force working under the relatively low pressure LP introduced into the chamber 44 upon the longitudinal shaft 16 and the lower surface of the O-ring seal 40

$F_6$: a force generated from a differential pressure between the relatively high pressure HP and the relatively low pressure LP working upon the piston 105

Downward force $F_3$: a rebound force from the bellows 34

$F_4$: a force fedback under the intermediate pressure AP introduced into the chamber 43 upon the upper surface of the O-ring seal 40

$F_5$: a rebound force from the coil spring 14

These working forces $F_1$, $F_2$, $F_4$ and $F_6$ may be expressed in the following equations; that is, $$F_1=K_1\times LP;\ F_2=K_2\times LP;\ F_4=K_3\times AP;\ F_6=K_6(HP-LP) \quad (4)$$

where, $K_1$ to $K_3$ and $K_6$ are constants which may be determined from the dimensions of the relevant parts.

Incidentally, the equation to attain the current balancing of such forces working upon the longitudinal shaft 16 may be expressed as follows;

$$F_1+F_2+F_6=F_3+F_4+F_5 \quad (5)$$

The following equation concerning AP may be obtained from the equations (4) and (5) above;

$$AP=a\times LP+b+c(HP-LP) \quad (6)$$

where, a, b and c are constants.

Figure 2:
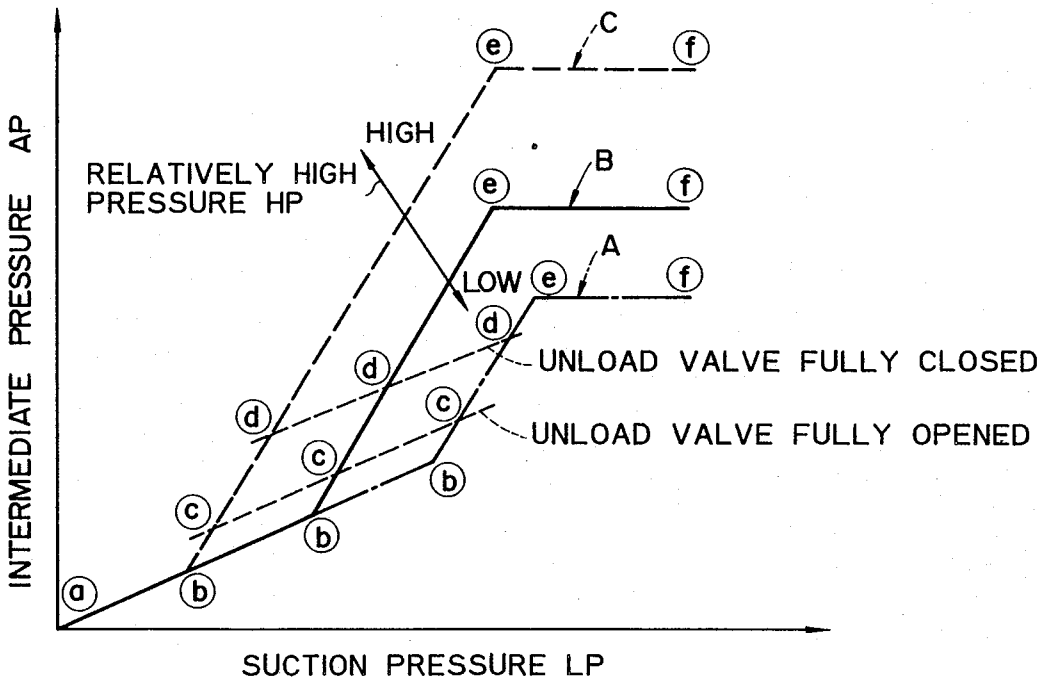
FIG. 2 is a graphic representation showing the pressure characteristics as attained from the improvement of the invention of FIG. 1.
Figure 3:
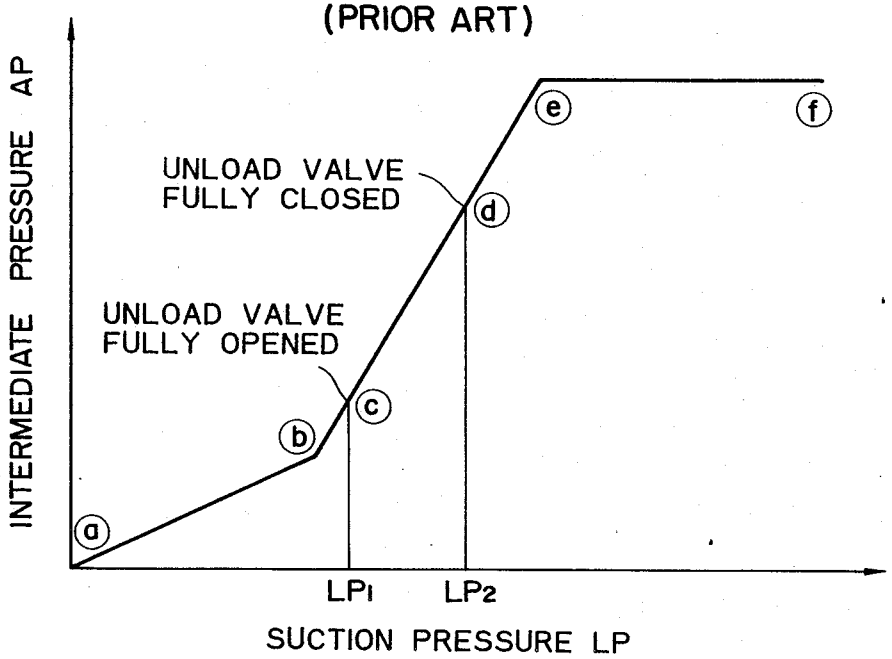
FIG. 3 (PRIOR ART)
FIG. 3 is a graphic representation showing the pressure characteristics as encountered in a conventional capacity control valve.

This equation (6) represents a straight line segment b - e in the three lines A, B and C as viewed in FIG. 2, which is a graphic representation showing the specific relationship of pressures LP and AP. Now, according to this graphic representation, it is notable that as HP, hence the value (HP−LP) increases, the intermediate pressure AP may change from the line A through the line B to the line C.

In this respect, as is apparent from FIG. 2, the higher the relatively high pressure HP, the higher the intermediate pressure AP, and accordingly, the relatively low pressure LP at the point c where the passage 9 in the unload valve turns to be opened completely becomes lower. On the other hand, the lower the relatively high pressure HP, the lower the intermediate pressure AP, and accordingly the relatively low pressure LP at the point d where the passage 9 in the unload valve turns to be closed completely becomes higher.

If the capacity control valve according to the present invention is reduced to practice in the manner as reviewed fully hereinbefore, when the relatively high pressure HP becomes higher with an increased thermal load on the part of the car cooler, it is feasible in practice to control the current pressure existing in the evaporator to be substantially low, and to the contrary, when the relatively high pressure HP becomes lower with a decreased thermal load on the part of the car cooler, the current pressure in the evaporator can be controlled to be high, accordingly.

It is to be understood that the appended claim is intended to cover all of such generic and specific features as are particular to the invention as disclosed herein and all statements relating to the scope of the invention, which as a matter of language might be said to fall thereunder.

We claim:

1. A capacity control valve for use in a fluid compressor with a relatively high pressure HP and a relatively low pressure LP thereacross, said capacity control valve being operative to take said intermediate pressure AP, for the control of a specific amount of compressed gas to be bypassed to the suction side of said fluid compressor, as a linear function of said relatively low pressure LP using a differential pressure between said relatively high pressure HP and said relatively low pressure LP of said fluid compressor; which comprises an adjusting means adapted to adjust said intermediate pressure AP in such a manner that said relative low pressure LP is made lower as said relatively high pressure HP becomes higher, and that said relatively low pressure LP is made higher as said relatively high pressure HP becomes lower.

* * * * *